US005664611A

United States Patent [19]

McDowell

[11] Patent Number: 5,664,611

[45] Date of Patent: Sep. 9, 1997

[54] PRIMARY LOG BREAKOUT MACHINE

[76] Inventor: Merle McDowell, 3432 Hayneville Rd., Montgomery, Ala. 36108

[21] Appl. No.: 593,202

[22] Filed: Jan. 29, 1996

[51] Int. Cl.[6] ..... B27C 9/00; B27C 5/00

[52] U.S. Cl. ..... 144/39; 144/3.1; 144/242.1; 144/369; 83/435.11; 83/711

[58] Field of Search ..... 144/1.1, 3.1, 39, 144/41, 242.1, 245.1, 367, 369, 378; 83/404.4, 435.1, 435.15, 345.16, 710, 711

[56] References Cited

U.S. PATENT DOCUMENTS

| | | | |
|---|---|---|---|
| 2,964,074 | 12/1960 | Brown | 144/242.1 |
| 4,846,237 | 7/1989 | Wolf | 144/369 |
| 5,224,530 | 7/1993 | Wolf | 144/369 |
| 5,253,685 | 10/1993 | Wolf | 144/378 |
| 5,441,092 | 8/1995 | Randle | 144/378 |

*Primary Examiner*—W. Donald Bray

*Attorney, Agent, or Firm*—Jacobson, Price, Holman & Stern, PLLC

[57] ABSTRACT

A machine in which a log is transported through the machine center for chipping or sawing a slab from both sides of the log in a single pass and/or sawing a side board or flitch from one or both sides of the log in a single pass and/or sawing multiple boards by reciprocating the log through the center of the machine. This invention relates specifically to the center carriage feed system having a bottom carriage and a top carriage in which the bottom carriage supports the log continuously for its full length and the top carriage utilizes hold down bars or dogs that engage the top of the log. The bottom carriage includes a log supposing vertical member having a transverse member at its lower end provided with a wheel at each end to engage widely spaced parallel tracks. One of the wheels and tracks are of V-shaped configuration to stabilize and guide the vertical log supporting member to reduce lateral deflection. The other track and wheels are flat. The wheels and tracks effectively support the log throughout its length and during its reciprocatory movement.

11 Claims, 5 Drawing Sheets

PRIMARY LOG BREAKOUT MACHINE

BACKGROUND OF THE INVENTION

1. Field of the Invention

The present invention generally relates to a machine in which a log is transported through the machine center for chipping or sawing a slab from both sides of the log in a single pass and/or sawing a side board or flitch from one or both sides of the log in a single pass and/or sawing multiple boards by reciprocating the log through the center of the machine. This invention relates specifically to the center carriage feed system having a bottom carriage and a top carriage in which the bottom carriage supports the log continuously for its full length and the top carriage utilizes hold down bars or dogs that engage the top of the log. The bottom carriage includes a log supporting vertical member having a transverse member at its lower end provided with a wheel at each end to engage widely spaced parallel tracks. One of the wheels and tracks are of V-shaped configuration to stabilize and guide the vertical log supporting member to reduce lateral deflection. The other track and wheels are flat. The wheels and tracks effectively support the log throughout its length and during its reciprocatory movement.

2. Description of the Prior Art

Existing machines of the above type are supported by a continuous vertical log supporting member engaging the bottom center of the log with the supporting member having a plurality of aligned V-shaped wheels at its lower end directly aligned with the bottom center of the log. These wheels engage a single inverted V-shaped track also aligned with the bottom center of the log so that the log supporting member can pivot or be laterally deflected about the single centrally located track even though top dogs hold the log in opposed relation to the log supporting member.

The prior art does not utilize a supporting structure for the log equivalent to the structure of this invention in which the log supporting member includes a vertical member which continuously engages the log throughout its length with the log supporting member being thin in cross section to allow chippers and/or saws to be set to a minimum cant thickness of 3 inches with the vertical support member being rigidly connected to a wide bottom carriage below the chippers or saws. The bottom carriage includes laterally spaced wheels engaging spaced tracks oriented in laterally spaced relation to both sides of the bottom center of the log to provide substantially greater stability as compared to the existing support structure for the log in which aligned wheels engage a single track oriented in alignment with the bottom center of the log.

SUMMARY OF THE INVENTION

An object of the present invention is to provide a unique support for a log passing through a log chipping and/or sawing machine which provides a stable support for the log while permitting it to pass between opposed rotary chippers and/or circular saws. The support includes a bottom carriage having wheels spaced to either side of the log to engage laterally spaced continuous tracks in order to maintain the log centrally located between the chippers and/or saws.

Another object of the invention is to provide a thin steel support for a log in accordance with the preceding object to form a cant that is less than 4 inches wide with the support extending between and below the saws and/or chippers and secured to the bottom carriage which is unobstructed in width by the machine.

Still another object of the invention is to provide a log support in which dual continuous tracks are provided for stability of the bottom carriage. One of the tracks is a V-track for supporting and guiding V-wheels at one side of the carriage. The wheels and track at the opposite side of the bottom carriage are flat for effective support.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
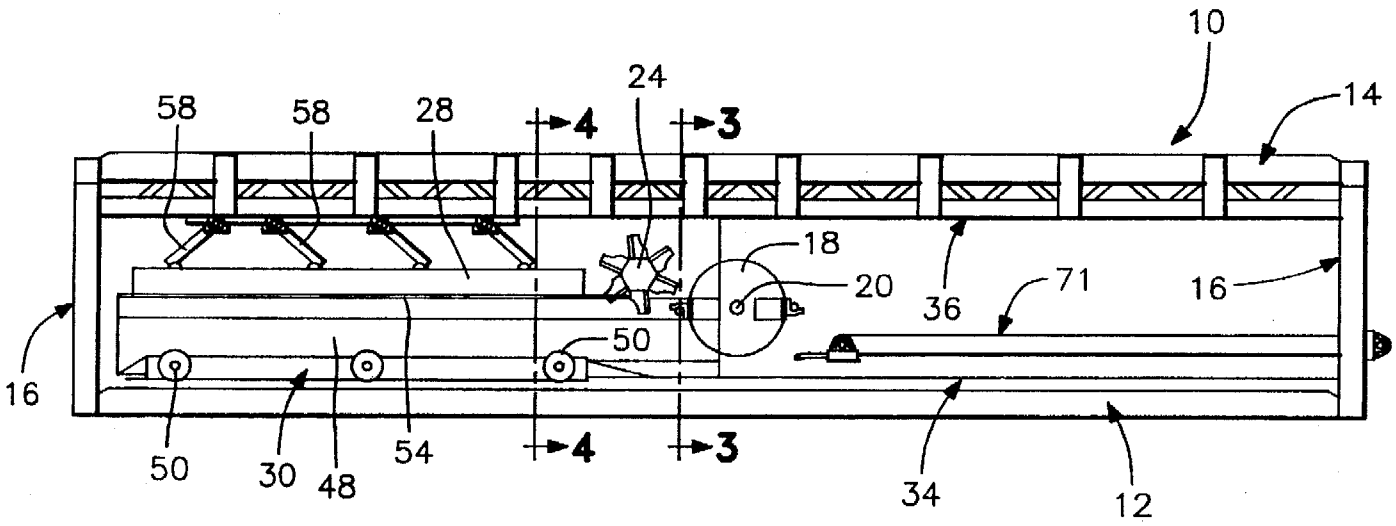
FIG. 1 is a side elevational view illustrating schematically the components of the machine with the unique log support and bottom carriage of this invention incorporated therein.
Figure 2:
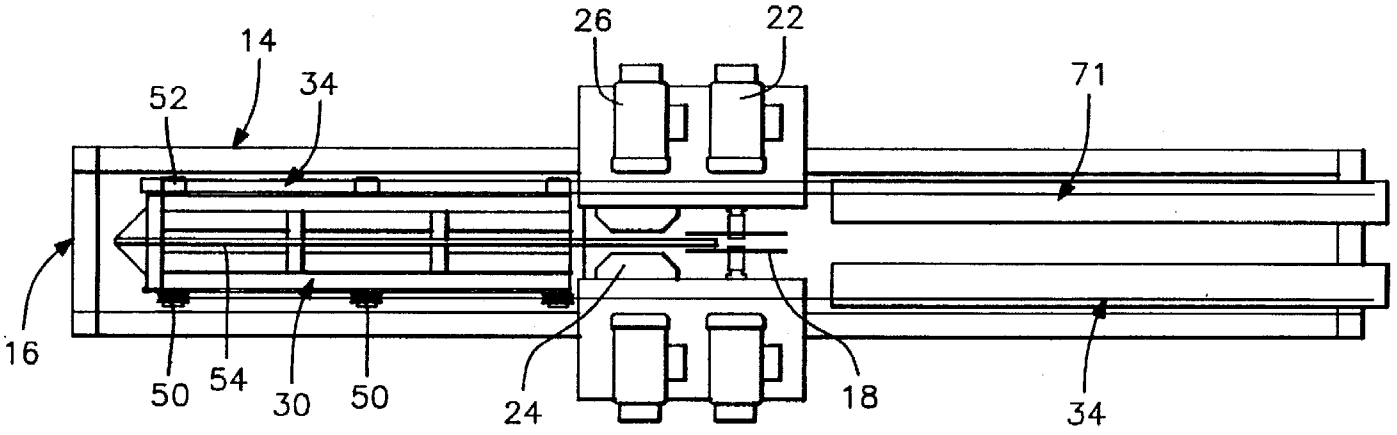
FIG. 2 is a top plan view of the machine.

Referring now to FIGS. 1 and 2, the machine of the present invention is generally designated by reference numeral 10 and includes a rigid bottom frame 12 and a rigid top frame 14 interconnected by rigid end frames 16. Supported centrally of the elongated frame is a pair of spaced circular saws 18 supported on arbors 20 and driven by suitable electric motors 22 operatively connected thereto. Also supported from the frame is a pair of chippers 24 driven by motors 26 with the chippers being spaced from the saws 18 in the direction of movement of a log 28.

The log 28 is supported by a bottom carriage 30 and a top carriage 32 which can move longitudinally along supporting tracks 34 at the bottom frame 12 and supporting tracks 36 for the upper carriage at the upper frame 14. The structure of the bottom frame 12 is illustrated in more detail in FIGS. 3 and 4 and includes a pair of side rails 38 interconnected by transverse frame members 40. The side rails 38 are spaced laterally from each other and one side rail supports a continuous V-track 42 and the other side rail supports a continuous flat track 44 which form the bottom supporting tracks 34.

The bottom carriage 30 includes a plurality of spaced transverse carriage frame members 46 mounted on and supporting a thin, rigid continuous vertically extending log support 48. One end of each bottom carriage frame 46 is provided with a wheel having a V-shaped periphery hereinafter referred to as a V-wheel 50 and the other end of each carriage frame 46 is provided with a wheel having a flat peripheral surface hereinafter referred to as the flat wheel 52. As illustrated, the V-wheel 50 engages the V-track 42 and the flat wheel 52 engages the flat track 44. The log support 48 is a continuous thin rigid metal member having a saddle 54 at its upper end which continuously engages the entire length of the bottom center of a log 28 thereby supporting the log 28 for longitudinal movement above the arbors 20 and between the chippers 24 and through the saws 18. The steel log support 48 is rigid lengthwise and vertically and the transverse bottom carriage frames 46 and the wheels 50 and 52 engaging the spaced tracks 42 and 44 provide a stable support for the center bottom of the log. The top of the log is engaged by a plurality of top dogs 58 supported from the top carriage 32 which also is provided with wheels 60 on the outer ends thereof both of which are flat to engage flat tracks 36. The plurality of top dogs 58 on top carriage 32 are extendable and pivotal such as by hydraulic rams, pneumatic rams or the like to engage the center top of the log to hold it stationarily in opposed relation to the saddle 54 on log support 48. Thus, as the log is moved through the chippers, the chippers remove the outer opposed edge segments 64 of the log to provide chipped faces 66 on the log as it moves through the circular saws 18 as illustrated in FIG. 3.

The circular saws 18 are mounted on the arbors 20 which have spaced ends 68 that are oriented on opposite sides of the support 48. As illustrated, the diameter of the saws 18 may be such that the periphery thereof approaches but never contacts the bottom carriage frames 46 as illustrated in FIG. 3. The saws 18 will remove side boards or flitches 70 which have chipped faces 66 on the outer surfaces from the log thereby leaving a cant 56 which is generally 4 inches in width but can be as little as 3 inches in width. The side boards or flitches 70 drop onto conveyors 71, as illustrated in FIGS. 1 and 2, for movement to side edgers in a known manner. The top carriage 32 moves with the log as does the bottom carriage 30 and both carriages serve to provide stable lateral support for the log during the chipping operation and subsequentially during the sawing operation.

Figure 3:
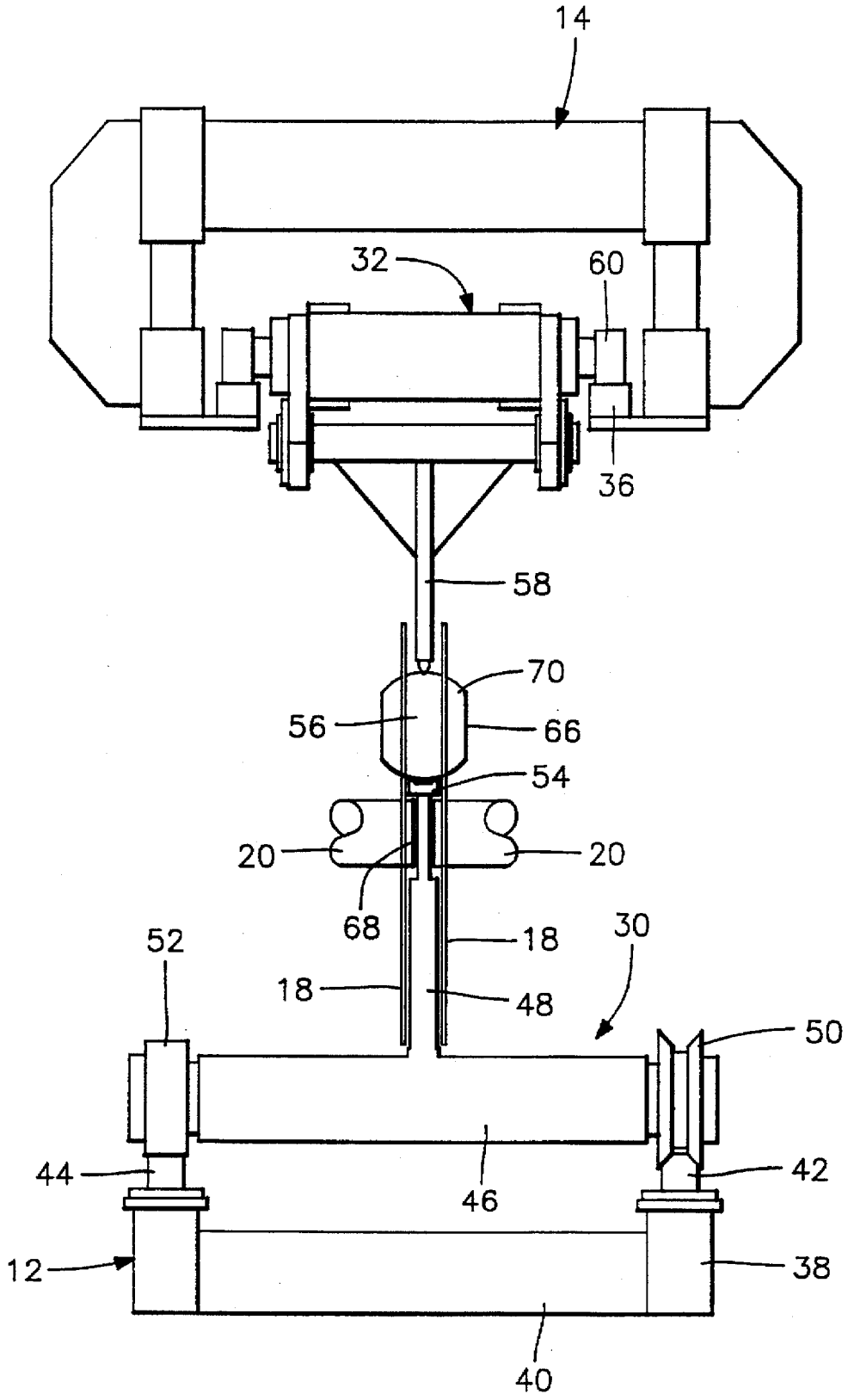
FIG. 3 is a transverse sectional view taken generally along section line 3—3 on FIG. 1 illustrating the structure of the unique log support of this invention in association with a pair of circular saws mounted on arbors having spaced ends.
Figure 4:
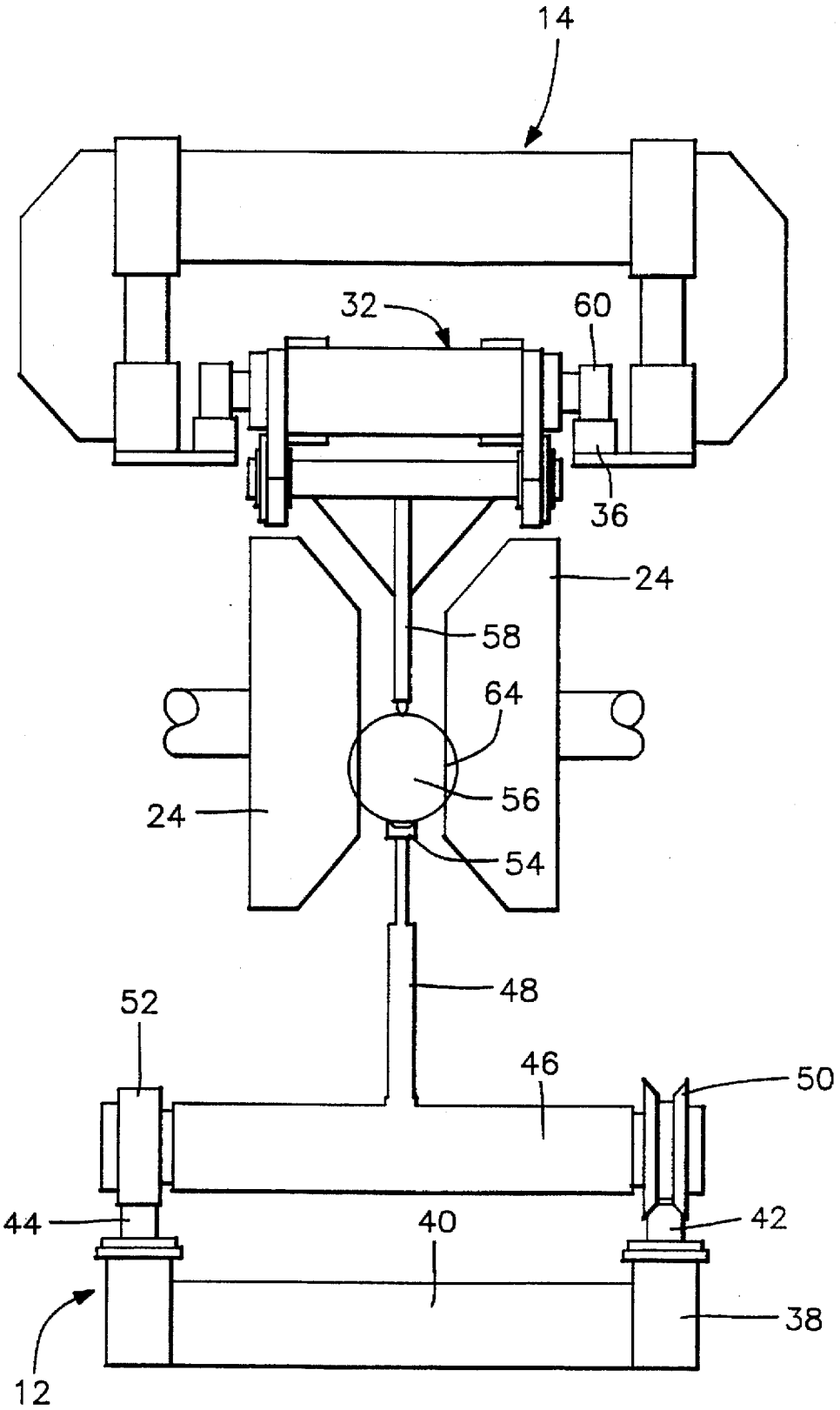
FIG. 4 is a transverse, sectional view taken along section line 4—4 on FIG. 1 illustrating the structure of this invention in association with a pair of chippers mounted on spaced arbors.
Figure 5:
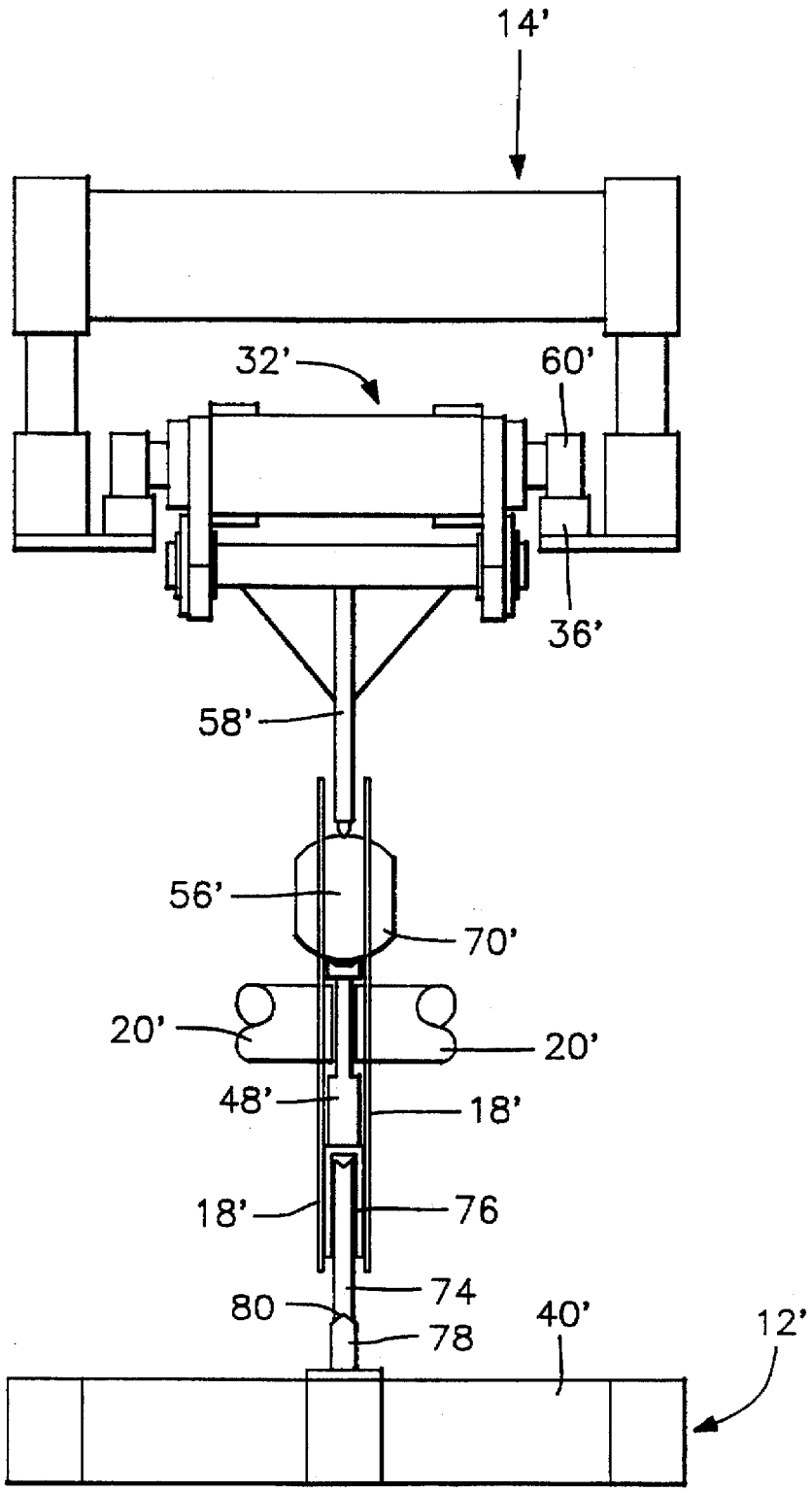
FIG. 5 (PRIOR ART)
FIG. 5 is a sectional view similar to FIG. 3 illustrating the prior art support for a log associated with circular saws.
Figure 6:
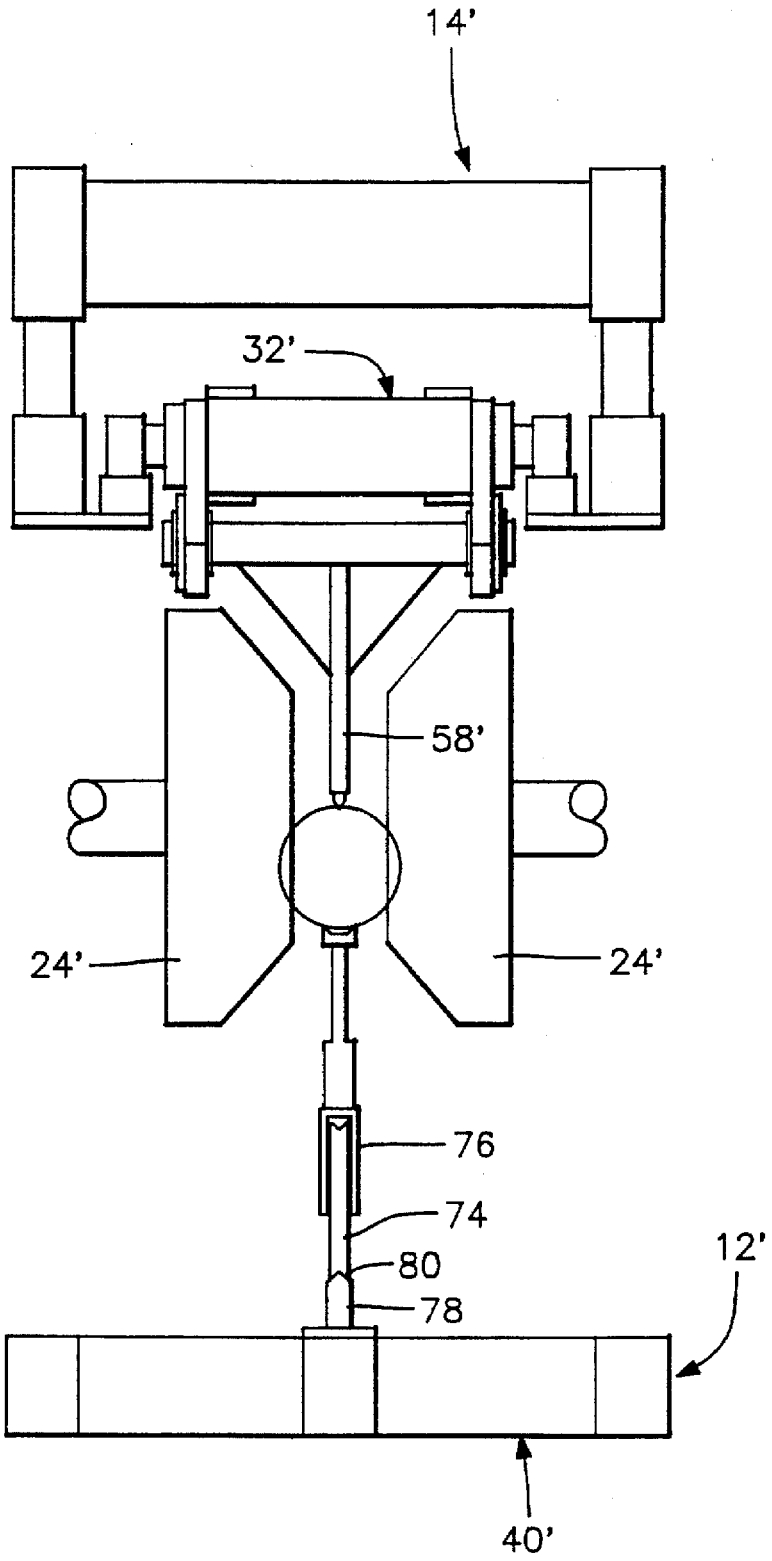
FIG. 6 (PRIOR ART)
FIG. 6 is a sectional view similar to FIG. 4 illustrating the prior art log support associated with a pair of chippers.

FIGS. 5 and 6 are comparable to FIG. 3 and 4 but illustrate the existing prior art structures in which the upper carriage, top dogs and associated chipper head and circular saws and arbors are the same and the same reference numerals are used to designate these components with the reference numerals on the prior art structures being primed. In this structure, the log support 48' is associated with the log and the chipper heads and saws in the same manner but in the prior art structure, the lower end of the log support 48' is provided with a plurality of V-wheels 74 supported rotatably from the log support 48' by a V-wheel frame 76. The V-wheels 74 are in alignment with each other and in alignment with and directly under the saddle 54' and log in which the supporting force is totally and directly in alignment with the center of the log and the center of the periphery of the V-wheels 74. The V-wheels 74 engage a single track 78 having an inverted V-shaped upper edge 80. The track 78 is supported from a bottom frame 40'. This structure provides a support in direct alignment with the log but the support structure formed by the V-wheels 74 and the V-track 78 permits the log in some instances to pivot or deflect laterally due to the forces exerted on the log by the chipper heads or saws even thoughthe top dogs 58' exert a downward pressure on the top center of the log during movement of the log and top and bottom carriages through the machine. In this structure of the prior art, the bottom carriage, consisting of a plurality of longitudinally aligned V-wheels 74 oriented in a single row directly under the bottom center of the log engaging a single continuous upwardly facing V-track 78, provides a support for the log that is much less stable as compared to the support for the log illustrated in FIG. 3 and 4 in which the support 48 is rigid with the bottom carriage frame members 46 which are each provided with laterally spaced wheels 50 and 52 engaging the laterally spaced tracks 42 and 44 with the wheels 50 and track 42 being V-shaped and the wheels 52 and track 44 being flat.

As indicated, the machine transports a log with the center of the log being equally spaced from chipper heads or saw blades to remove a slab from one or both sides of the log in a single pass or to saw a board or flitch from one or both sides in a single pass or saw multiple boards by reciprocating through the machine center. The feed system includes a bottom carriage and a top carriage with the bottom carriage supporting a log for its full length and the top carriage utilizing pivoting or telescoping top dogs or bars that come down on the top of the log to force it down onto the bottom carriage to secure the log as it passes through the machine center. The center feed system allows the chippers and/or the saws on each side to be oriented at least to within 4 inches of each other and which requirement dictates the bottom carriage configuration since no part of the bottom carriage or the top carriage can violate the center area of the machine.

Likewise, in the existing machines as illustrated in FIGS. 5 and 6, the top Carriage and dogs and the bottom carriage supported and guided by a single V-track and a single row of V-wheels do not violate the 4 inch machine center area. The steel support that supports the log is thin and extends below the saws and chippers and is supported by the single row of aligned V-wheels and single track which do not violate the 4 inch machine center area.

The bottom carriage 30 of this invention is approximately 48 inches wide and incorporates a dual track system for stability of the log support bar or saddle 54. Underlying one side of the bottom carriage 30 is a V-track 42 for supporting and guiding the V-wheels 50 and under the other side is a flat track 44 for supporting the flat wheels 52. The upwardly extending vertical member 48 which supports the log 28 is thin in section to allow chippers 24 and/or saws 18 to be set to a minimum cant thickness of 3 inches. The vertical support member for the log is attached to the wide bottom carriage frame members 46 in a rigid manner. The frame members 46 are oriented below the chippers and/or the saws and the wide extent of the bottom carriage 30 gains stability over existing systems by reducing the possibility of tilting or deflecting movement of the log support member 48 which can be caused by the chippers and/or saws contacting portions of the logs which have greater resistance to chipping or sawing by the bottom carriage being supported at its lateral extremities of its width by the pair of laterally spaced linear support tracks and wheels. The bottom carriage 30 can also be guided and supported by laterally spaced linear tracks having other configurations with the side extremities of the bottom carriage including structures such as linear bearings engaging the tracks for guided and supported movement of the bottom carriage on the tracks.

The manner of reciprocating the bottom and top carriages through the machine is a conventional cable or hydraulic system. Also, the drive mechanism and controls for the chippers, saws and top dogs are all conventional and well known. This type of machine is primarily used in breaking out logs having relatively small diameters generally in the range of 6 to 8 inches and a length of about 8 to 20 feet.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In a log breakout machine having an elongated rigid bottom frame, an elongated rigid top frame, end frames supporting the top and bottom frames generally in parallel rigid relation, a longitudinal bottom track structure on the bottom frame, a longitudinal top track structure on the top frame, a bottom carriage mounted on the bottom track structure, a top carriage mounted on the top track structure, a log support member on the bottom carriage engaging the bottom center of a log substantially throughout its length, log engaging members on the top carriage engaging the top center of the log and retaining it on the bottom log support member, a pair of opposed, aligned and spaced log treating structures on opposite sides of the path of movement of the log and engaging opposite sides of the log, said log support member and top engaging members being located in the space between the log treating structures to enable longitudinal movement of the log between the log treating structures, the improvement comprising the log supporting member engaging the bottom center of the log being a thin vertically extending member, a plurality of spaced, transversely extending bottom carriage members at a bottom portion of the log supporting member, said bottom carriage members forming part of the bottom carriage and a carriage supporting member at each end of each bottom carriage member, said bottom track structure including a pair of laterally spaced, parallel tracks engaging and supporting said carriage supporting members to enable longitudinal movement of the bottom carriage on the frame with the transverse spacing of the carriage supporting members and tracks providing lateral stability to the log supporting member engaging the bottom center of the log.

2. The machine as defined in claim I wherein one of said carriage supporting members is a wheel on one end of each bottom transverse carriage member provided with a V-shaped periphery, one of said laterally spaced tracks on the bottom frame structure including an inverted V-shaped configuration along a top edge to support and guide said wheel having a V-shaped periphery thereby guiding and supporting the bottom carriage during its movement.

3. The machine as defined in claim 2 wherein the wheel on an opposite end of each bottom transverse carriage member is flat and the other of said laterally spaced tracks on the bottom frame structure is flat for support of the bottom carriage during its movement.

4. The machine as defined in claim 1 wherein said log treating structures includes a pair of spaced circular saws mounted on independent spaced arbors with the bottom log supporting member extending between the ends of the arbors.

5. The machine as defined in claim 1 wherein said log treating structures includes a pair of chipper heads arranged in opposed relation and supported by arbors that are spaced apart to enable the log supporting member to extend between said arbors.

6. The machine as defined in claim 3 wherein said log treating structures includes a pair of chipper heads mounted on spaced opposed arbors and a pair of circular saws mounted on spaced opposed arbors, said chipper heads being disposed in advance of said saws in the direction of movement of a log through the machine.

7. A log sawing machine including a carriage reciprocally movable past a pair of laterally spaced parallel, opposed circular saws supported on arbors having ends spaced apart, said carriage including a generally vertical rigid log support extending upwardly between the arbors and supportingly engaging a log being transported between said saws above and in perpendicular relation to the arbors, a bottom track structure supporting said carriage, said track structure including a pair of laterally spaced parallel tracks, said carriage including a plurality of longitudinally spaced supports rigid with respect to said log support, said supports being laterally spaced and supportingly and guidingly engaged with said laterally spaced tracks to laterally stabilize said log support and a log supported thereon during movement past said saws.

8. The machine as defined in claim 7 wherein said log support extends above a rotational center of said saws and supports the log throughout its length, said carriage including a plurality of longitudinally spaced transversely extending carriage frame members rigid with a lower portion of said log support, said supports including pairs of wheels with the wheels of each pair being rotatably mounted on one of said transversely extending carriage frame members in supporting engagement with said tracks for laterally stabilizing said carriage, said log support and a log supported on the log support during movement past the saws when the saws are being driven and making saw cuts on the log.

9. The machine as defined in claim 8 wherein one of said tracks and one wheel of each pair includes interengaging structure to guide the movement of the wheels on the tracks.

10. The machine as defined in claim 9 wherein said interengaging structure includes an inverted V-shaped top surface on one of said tracks, said one wheel of each pair including a V-shaped groove in a periphery thereof for guiding engagement with the inverted V-shaped top surface on said one of said tracks.

11. The machine as defined in claim 10 wherein said log support is a thin vertical member extending throughout the length of the log, said transversely extending carriage frame members being rigid with a lower edge portion of said vertical member, and said wheels and tracks being widely and substantially equally spaced to either side of the vertical member and the log supported thereon to laterally stabilize the log against lateral forces exerted thereon when the saws are making saw cuts during movement of the log past the saws.

* * * * *